US007252214B2

(12) United States Patent
Krogh

(10) Patent No.: US 7,252,214 B2
(45) Date of Patent: Aug. 7, 2007

(54) HARNESS FOR CARRYING

(76) Inventor: Margit Krogh, Norr Mälarstrand 30, 5-112 20, Stockholm (SE)

( * ) Notice: Subject to any disclaimer, the term of this patent is extended or adjusted under 35 U.S.C. 154(b) by 535 days.

(21) Appl. No.: 10/488,511

(22) PCT Filed: Sep. 2, 2002

(86) PCT No.: PCT/SE02/01558

§ 371 (c)(1),
(2), (4) Date: Mar. 3, 2004

(87) PCT Pub. No.: WO03/020083

PCT Pub. Date: Mar. 13, 2003

(65) Prior Publication Data

US 2004/0238579 A1 Dec. 2, 2004

(30) Foreign Application Priority Data

Sep. 3, 2001 (SE) ..... 0102916
Jan. 2, 2002 (SE) ..... 0200001

(51) Int. Cl.
*A61G 1/00* (2006.01)

(52) U.S. Cl. ..... 224/160; 224/158; 224/159

(58) Field of Classification Search ..... 224/158–160, 224/623–625, 236, 237
See application file for complete search history.

(56) References Cited

U.S. PATENT DOCUMENTS 3,027,058 A * 3/1962 Huber ..... 224/160
3,575,326 A * 4/1971 Chappell ..... 224/159
4,492,326 A * 1/1985 Storm ..... 224/160
4,724,988 A * 2/1988 Tucker ..... 224/160
4,986,458 A * 1/1991 Linday ..... 224/160
5,690,258 A * 11/1997 Kataoka ..... 224/160
5,848,741 A * 12/1998 Fair ..... 224/160
6,045,018 A * 4/2000 Onishi ..... 224/158
6,182,873 B1 * 2/2001 Christopher et al. ..... 224/159

FOREIGN PATENT DOCUMENTS

JP 2000296034 * 10/2000

* cited by examiner

*Primary Examiner*—Nathan J. Newhouse
*Assistant Examiner*—Margaret Olson
(74) *Attorney, Agent, or Firm*—Rolf Fasth; Fasth Law Offices

(57) ABSTRACT

The invention relates to a wearer-adapted and a child/infant supporting harness (1) that includes a first strap portion (2), which is intended to extend obliquely over the wearer's chest (A1) and over a shoulder (A2) of said wearer and obliquely over part (A3) of the wearer's back. A second strap portion (3) is intended to extend around the wearer. The harness also includes a child-holding folded part (4) that has a first region (4*a*), which can be placed proximate to the wearer (A), and a second region (4*b*) that can be placed distal from the wearer, and a third region (4*c*), which connects said first and second regions and which is narrower than said regions. Two elongate sections (4*a*3, 4*a*4) extend from mutually opposite edge portions (4*a*1, 4*a*2) of first region (4*a*) of said folded part (4). The end portions (4*a*3', 4*a*4') of the elongate sections are provided with and/or co-act with means (5) for ready connection with or ready disconnection from the wearer-distal outer surface (4*b*') of said second region (4*b*).

27 Claims, 5 Drawing Sheets

Fig. 1
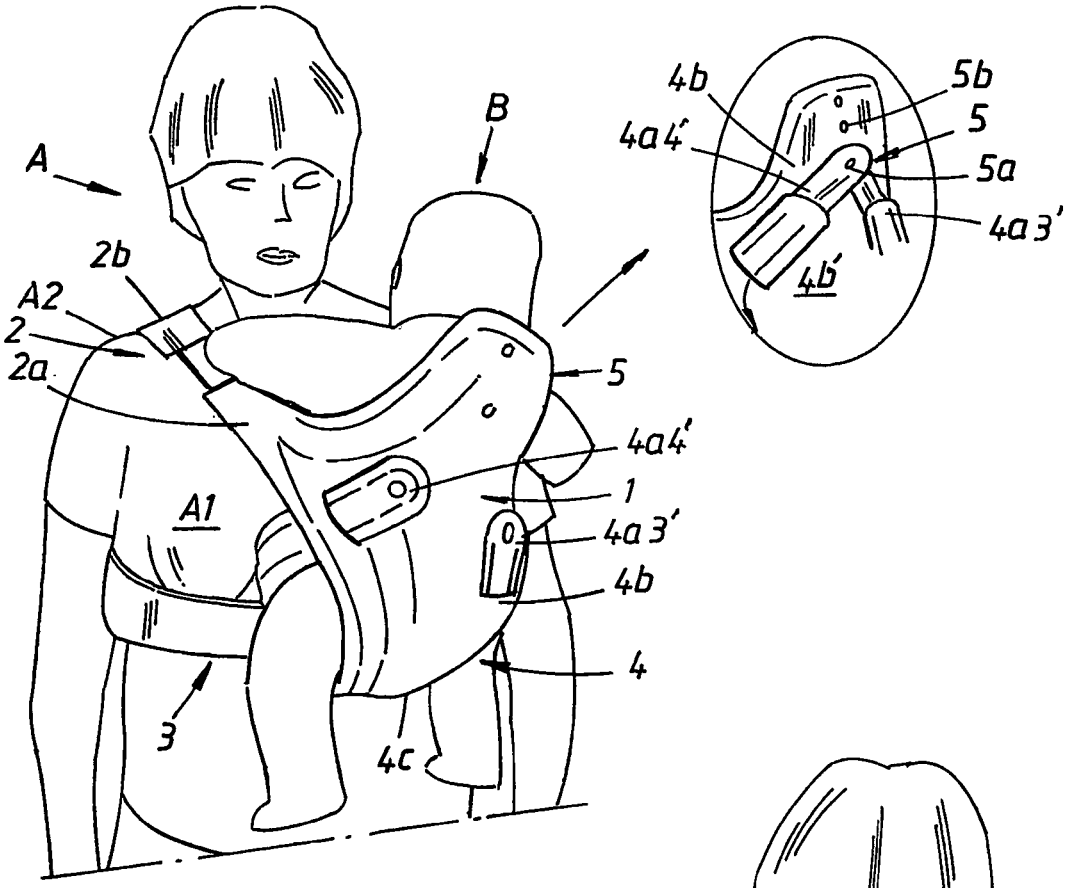
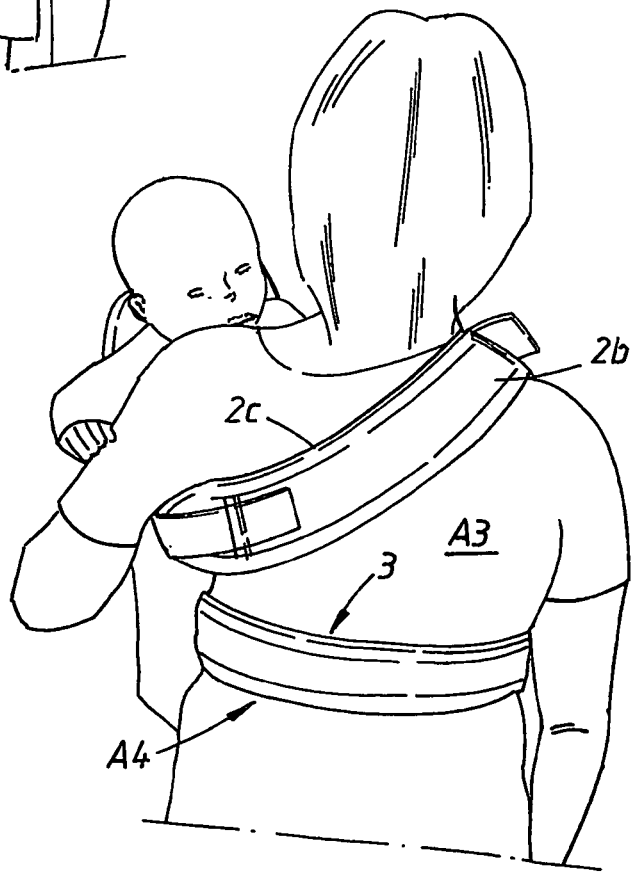
Fig. 2

HARNESS FOR CARRYING

This application is a U.S. National phase application based on International Application No. PCT/SE02/01558, filed 2 Sep. 2002, claiming priority from Swedish Patent Application Nos. 0102916-4, filed 3 Sep. 2001 and 0200001-6, filed 2 Jan. 2002.

FIELD OF INVENTION

The present invention relates generally to a harness and then more particularly, but not exclusively, to a wearer-adapted and a child or infant supporting harness.

Still more particularly, the invention pertains to a harness that can be used conveniently with children, such as children up to two years of age.

A harness of the aforesaid category includes a first strap portion, which is intended to extend obliquely over the wearer's chest and over one shoulder of the wearer and obliquely over part of the wearer's back.

A harness of this particular category also includes a second strap portion, which is intended to pass around the wearer's waist.

Harnesses of this kind include a child-supporting folded part that includes a first region, which faces towards the wearer, a second region, which faces away from the wearer, and a third region, which joins together the first and second regions and which is much narrower than said first and second regions.

These regions are mutually integral such as to form a unit. The division into different regions has been mentioned solely for the purpose of clarification.

Harnesses of this kind have been judged to be particularly suitable for supporting children, such as children up to two years of age, preferably infants younger than one year of age and then between two and nine months.

DESCRIPTION OF THE BACKGROUND ART

Several different harness designs adapted for wearers and children/infants are known to the art.

A first harness category includes two first strap portions, which are adapted to extend parallel over the wearer's chest and over a respective shoulder of the wearer, and down over part of the wearer's back.

Harnesses of this first category can also be supplemented with a second strap portion, which is adapted to extend around the wearer's hips.

It is also known to apply to the first strap portions and/or to the second strap portion a child-supporting folded part.

This folded part includes a first region that lies proximate to the wearer, a second region that lies distal from said wearer, and a third region which joins the first and the second regions together and which is narrower than said first and second regions.

Children and/or infants carried by a harness of this design will thus be positioned centrally in front of and adjacent the wearer's stomach, and thus obstruct the wearer's vision with respect to the ground structure and floor structure immediately in front of the wearer, with the subsequent risk of stumbling.

Also known to the art is a second harness category, which has the same purpose as the afore described first category and to which the present invention relates.

This second category is based on the ability to provide a wearer-adapted and child/infant supporting harness that includes only one first strap portion.

This strap is intended to extend obliquely over the wearer's chest, and over both shoulders of the wearer and also obliquely over part of the wearer's back.

The second harness category also includes a second strap portion, which is intended to extend around the wearer's hips.

A folded child/infant supporting part includes a first region that lies proximate to the wearer, a second region that lies distal from the wearer, and a narrower third region, which joins together said first and said second regions.

It is also known to cover said straps with soft material, either totally or partially, and also to allow said straps to be divided into two portions, that can be mutually connected by means of a two-part coupling device.

It is also known to enable the length of one or more of said belt portions to be adjusted, so as to suit the wearer's wishes and the size of the child/infant carried in the harness.

SUMMARY OF THE PRESENT INVENTION

Technical Problems

When taking into consideration the technical deliberations that a person skilled in this particular art must make in order to provide a solution to one or more technical problems that he/she encounters, it will be seen that it is necessary initially to realise the measures and/or the sequence of measures that must be undertaken to this end on the one hand, and on the other hand to realise which means is/are required to solve one or more of said problems. On this basis, it will be evident that the technical problems listed below are highly relevant to the development of the present invention.

When considering the present standpoint of techniques as described above, it will be seen that in respect of a harness of the aforesaid second category a technical problem resides in the ability to provide conditions which enable the weight of the child/infant to be supported primarily by a second strap portion, and with which the harness construction in general will position the child/infant such that the wearer will have a clear view of the ground or floor immediately in front of his/her feet, and which enable the wearer to bend forwards easily.

A technical problem also resides in the ability to realise the significance of and the advantages associated with designing a harness with which the child/infant will be supported at a high level, such as a level representative of the level that would apply if the child should be carried on a person's bent arm on one side of the person.

Another technical problem resides in the ability to realise the significance of and the advantages associated with the provision of construction directions that inform a user that a second strap portion may be placed at a high level, such as immediately beneath the wearer's bust, adjacent the diaphragm or some similar place, such as at the wearer's waist.

A technical problem also resides in the ability to provide a simple construction that is sufficiently flexible to allow the length of the first strap portion and the length of the second strap portion to be adjusted, so as to achieve a carrying position that is comfortable for the child/infant, among other things.

Another technical problem resides in the ability to realise the significance of and the advantages associated with allowing two elongate sections to extend in a respective individual direction from the edges of a folded portion opposite the upper portion of the first region.

Another technical problem resides in the ability to realise the significance of and the advantages afforded by allowing these sections to extend behind and to embrace a second region in addition to the child/infant.

Another technical problem resides in the ability to realise the significance of and the advantages associated with allowing said sections to pass slidingly through a respective slot, provided in said second region.

Another technical problem resides in the ability to realise the significance of and the advantages afforded by allowing the end parts of said elongate sections to be provided with and/or co-ordinated with means for ready connection to and ready detachment from the outer surface of the second region that lies distal from, i.e. faces away from, said wearer.

Another technical problem is one of conveniently enabling the active length of the elongate sections to be adjusted, such as via said means, with the aid of simple constructive measures.

Another technical problem resides in the ability to realise the significance of and the advantages associated with allowing the ends of respective elongate sections to be joined to a first part and to a second part of a two-part coupling device.

Another technical problem resides in the ability to realise the significance of and the advantages afforded by allowing at least one, normally some, second part(s) of said two-part coupling device to be coordinated with and/or fastened to an outer surface of the second region that is easily reached by the wearer.

A further technical problem resides in the ability to realise the significance of and the advantages afforded by distributing the second parts of the two-part coupling device so as to obtain the correct active lengths in respect of the child/infant in the proximity of said sections, with regard to the chosen position and the weight and size of the child carried in the harness.

In this regard, a technical problem resides in the ability to establish suitable distribution of said second parts of the two-part connector arrangement in both a vertical and lateral direction.

A further technical problem resides in the ability to realise the significance of and the advantages associated with allowing the length of the first strap portion to be adjusted and to include a hook-equipped coupling device.

Yet another technical problem resides in the ability to realise the significance of and the advantages afforded by also enabling the length of the second strap portion to be adjusted, and also to provide said portion with a hook-equipped coupling device.

A further technical problem resides in the ability to realise the significance of and the advantages afforded by allowing said second strap portion to pass through two V-shaped, laterally displaced slots allocated to the folded portion, and then disposed within the lower part of the first region.

Another technical problem resides in the ability to realise the significance of and the advantages afforded by giving said first portion a pronounced or stylised triangular shape, with upwardly diverging sides.

A further technical problem also resides in the ability to realise the significance of and the advantages associated with giving the second region an upwardly divergent shape with its upper portion having a centrally orientated, tapering form, whose inwardly facing surface is adapted to function to support the head of the child/infant and whose outwardly facing, outer surface functions to carry one or more identical second parts of said two-part coupling device.

A further technical problem resides in the ability to realise the significance of and the advantages associated with allowing said first region to include and/or or to be connected to two elongate, outwardly narrowing sections and therewith partially form said first strap portion.

A further technical problem resides in the ability to realise the advantages that are afforded by allowing both the first region and the second region to have the shape of the lower part of a truncated triangle that has, in principle, similar divergent angles and with a truncated section connecting with the third region.

In addition, a technical problem resides in the ability to realise the significance of and the advantages afforded by a neck-supporting, hood-configured unit to be readily attached to an upper part of the second region, and therewith create conditions, which enable the harness to be adapted to at least two age groups within a chosen age range, at least up to an age of two years.

Another technical problem resides in the ability to realise the significance of and the advantages afforded by allowing a first age group to include infants, such as babies of up to two months of age, and a second age group to include somewhat older infants/children.

A further technical problem resides in the ability to realise the significance of and the advantages associated with allowing said unit to be readily attached to and readily removed from said upper portion of said second region through the medium of fastener means chosen to this end.

Still a further technical problem resides in the ability to realise the significance of and the advantages afforded by allowing said fastener means to have the form of a touch-and-close fastener.

Another technical problem resides in the ability to realise the significance of and the advantages afforded by enabling the fastening between the hood-shaped unit and the upper part of the second region to be readily adjusted and set in a chosen position vertically and/or laterally.

Still a further technical problem resides in the ability to realise the significance of and the advantages afforded by providing the hood-shaped unit with mutually opposite flaps, which can be fastened to sections allocated to the second region, with the aid of simple fasteners.

In addition, a technical problem resides in the ability to realise the significance of and the advantages afforded by allowing said fastener to have the form of a touch-and-close fastener.

Yet another technical problem resides in the ability to realise the significance of and the advantages afforded by allowing the hood-shaped unit to have a readily folded and unfolded hood-forming part.

A further technical problem resides in the ability to realise the significance of and the advantages associated with allowing said first region and said second region to be coordinated over said third region such as to form a readily obtained integral unit.

Another technical problem resides in the ability to realise the significance of and the advantages associated with allowing said means, its first and second parts, to have the form of a buckle or clasp, such as a snap-on buckle or clasp.

Another technical problem resides in the ability to realise the significance of and the advantages afforded by allowing said oppositely positioned edge portions and/or sections to be adapted for infants, for instance babies up to two months old, and to allow the arms of the infant to be encompassed by the sections and said second part.

A further technical problem resides in the ability to realise the significance of and the advantages afforded by adapting said edge portions and/or sections and the flaps allocated to the hood-shaped unit, so as to allow the arms of the infant, from two months upwards, to be accommodated there between.

Another technical problem resides in the ability to realise the significance of and the advantages associated with distributing the second parts of the two-part coupling device so as to enable the sections close to the infant or child to be adjusted to the correct effective length with respect to the position, weight and size of the child.

In this regard, a technical problem resides in the ability to distribute the second parts of the two-part coupling device so as to enable said device to also extend laterally in addition to vertically.

A further technical problem resides in the ability to realise the significance of and the advantages afforded by enabling the length of the first strap portion to be adjusted and to include a hook-equipped coupling device or the like.

A further technical problem resides in the ability to realise the significance of and the advantages associated with also allowing the length of the second strap portion to be adjustable and to provide said portion with a hook-equipped coupling device or the like.

Another technical problem resides in the ability to realise the significance of and the advantages afforded by allowing said second strap portion to pass through two V-shaped and laterally displaced slots or the like in the folded portion and then within the lower part of the first region.

Another technical problem resides in the ability to realise the significance of and the advantages afforded by giving the first part a triangular shape that has upwardly divergent sides.

Still another technical problem resides in the ability to realise the significance of and the advantages afforded by giving the second region an upwardly divergent form whose upper portion has a centrally orientated tapering shape whose inwardly facing surface is adapted to serve as a support for the head of the child.

Still another technical problem resides in the ability to realise the significance of and the advantages afforded by allowing the first region to have and/or to be connected to two elongate and outwardly tapering sections such as to partially form said first strap portion.

Another technical problem resides in the ability to realise the advantages that are associated with allowing both the first region and the second region to have respectively the shape of the lower part of a truncated triangle that has principally similar divergent angles, with the truncated sections connecting with the third region.

Solution

The present invention thus takes its starting point from a child/infant supporting harness, and more particularly to a harness of the kind that includes a first strap portion, which is intended to extend obliquely over a wearer's chest and over a wearer's shoulder and obliquely over part of the wearer's back, and a second strap portion, which is intended to extend around the wearer's midriff and/or waist, and also a child/infant supporting folded portion having a first region proximate to the wearer, a second region distal from said wearer, and a third region, which connects said first and second regions and which is narrower than said regions.

With the intention of solving one or more of the aforesaid technical problems, it is proposed, in accordance with the invention, that two elongate sections shall extend from respective opposite edge portions of the first region belonging to the folded portion, that these sections are adapted to slide in a respective slot, at least one slot formed in the second region, and that the end portions of said elongate sections are provided with or coordinated with means for ready connection to or ready removal from the second region that lies distal, i.e. faces away, from the wearer.

By way of proposed embodiments, that lie within the basic concept of the present invention, it is proposed that the active length of the elongate sections shall be adjustable.

It is also proposed that two end portions of said elongate sections shall be connectable to each other with the aid of a first part of a two-part coupling device.

A second part of said two-part coupling device shall be coordinated with an outer surface of said second region.

More particularly, it is proposed that the length of the first strap portion can be adjusted and that said belt portion has a hook-equipped or loop-equipped coupling device.

The length of the second belt portion is also adjustable and is also provided with a hook-equipped coupling device.

It is also proposed that the second strap portion shall be capable of passing through two V-shaped slots in the first region.

It is also proposed that the upper central part of the second region is given an upwardly tapering shape whose inwardly facing surface is adapted to function as a support for the head of the child or infant carried in the harness, and that the outwardly facing surface of which region is adapted to carry a number of second parts of said two-part coupling device.

It is also proposed that two elongate sections are connected to said second region on a respective side of said support, such as to partially form said first strap portion.

With the intention of solving one or more of the aforesaid technical problems, it is proposed, in accordance with the present invention, that two elongate sections shall extend from a respective edge portion of the first region and belonging to said folded part, and that these sections shall be adapted to extend behind and embrace a child or infant on the one hand and the second region on the other hand, and that the end portions of said elongate sections are provided with or co-ordinated with means for ready connection with or ready removal from each other and/or from the second region distal from the wearer.

By way of proposed embodiments that lie within the scope of the inventive concept, it is also proposed that the effective length of the two elongate sections can be adjusted via said means.

It is also proposed that the end portions of said two elongate sections can be connected to each other via a first part and a second part of a two-part coupling device.

A hood-configured unit, that serves as a neck support, can be fastened to an upper part of the second region.

This unit can be readily connected to and readily disconnected from said upper part of the second region through the medium of appropriate fastening means.

It is proposed that said fastener means will primarily have the form of a touch-and-close fastener.

It is also proposed that the fastening between the hood unit and the upper part of the second region can be adjusted and readily removed both vertically and/or laterally.

It is also proposed in accordance with the invention that the hood unit will preferably include mutually opposite flaps, which can be fastened to and readily removed from sections allocated to the second region, via fastening means.

It is particularly proposed that said fastener means has the form of a touch-and-close fastener.

The hood unit will comprise a part that can be raised and lowered, said part forming the hood in a raised position.

The first region and the second region are coordinated over said third region and thereby have the form of an integrated and coordinated readily produced unit.

It is proposed that said coupling device, its first and its second parts, has the form of a clasp or buckle, such as a length-adjusting snap-action clasp.

The aforesaid mutually opposing edge portions and/or sections may be adapted so as to allow the arms of a baby/infant to be enclosed by said sections and said second region.

Said edge portions and/or sections and said flaps belonging to the hood unit may be adapted to allow the child's arms to pass there between.

More particularly, it is proposed that the length of the first strap portion can be adjusted and has a hook-equipped coupling device or the like.

It is also proposed that the length of the second strap portion can be adjusted and that said portion includes a hook-equipped coupling device or the like.

It is also proposed that said second strap portion is adapted to pass through two V-shaped slots in said first region.

The central portion of the second region may have an upwardly tapering configuration where the inwardly facing surface is adapted to serve as a support for the head of the child or infant.

It is also proposed that two elongate sections are connected to the second region on respective sides of said central support, so as to partially form said first strap portion.

Advantages

Those advantages primarily afforded by an inventive harness for supporting a child or an infant reside in the provision of conditions which enable the harness to support the child or infant comfortably in a high position and at least above the hips of the wearer, preferably immediately beneath the wearer's bust, and in the provision of simple means, which enable the child to be supported in a position in accordance with the child's weight and size.

Moreover, conditions have been created in which the child's weight primarily acts on the wearer's waist through the medium of a second harness strap-portion.

The use of an easily fitted and easily removed hood-shaped unit, that can be adapted to different heights, enables the harness to be adapted to at least two age categories, i.e. a first category with a fitted hood unit for babies (up to two months old) and a second category for slightly older children (say up to two years old) without needing to fit said hood unit.

The primary characteristic features of an inventive harness for supporting a child or an infant are set forth in the respective characterising clauses of the accompanying claim 1 and claim 10.

BRIEF DESCRIPTION OF THE DRAWINGS

Embodiments of a child or infant supporting harness, having characteristic features significant of the present invention and at present preferred, will now be described in more detail with reference to the accompanying drawings, in which FIG. 1 is a front view of a person wearing a first embodiment of an inventive harness, and shows an infant supported by the harness;

FIG. 2 is a rear view of the wearer of the harness shown in FIG. 1;

DESCRIPTION OF EMBODIMENTS AT PRESENT PREFERRED

It is pointed out initially that we have chosen to use in the following description of embodiments at present preferred and including significant characteristic features of the invention and illustrated in the figures of the accompanying drawings special terms and terminology with the intention of illustrating the inventive concept more clearly.

However, it will be noted that the expressions chosen here shall not be seen as limited solely to the chosen terms used in the description, but that each term shall be interpreted as also including all technical equivalents that function in the same or at least essentially the same way so as to achieve the same or essentially the same intention and/or technical effect.

FIG. 1 is a schematic illustration of a first embodiment of a harness 1 having the characteristic features of the present invention.

The significant features or properties of the present invention have been put in a generally concrete form by the proposed embodiment described below.

Thus, FIG. 1 illustrates a harness 1 adapted to a wearer A and supporting an infant B.

The harness 1 includes a first strap portion 2, which is adapted to extend obliquely across the upper chest portion A1 of the carrier or wearer A with the aid of a number of sections, such as the section 2*a*, and to extend over the wearer's shoulder A2 via a section 2*b*, and also to extend obliquely over an upper part A3 of the wearer's back, via a section 2*c*.

A second strap part 3 is adapted to extend around the wearer's midriff or waist A4.

It is particularly proposed that the second strap part 3 shall be placed at a high level, such as immediately beneath the bust or breast of the harness wearer, as shown in FIGS. 1 and 2.

Figure 4:
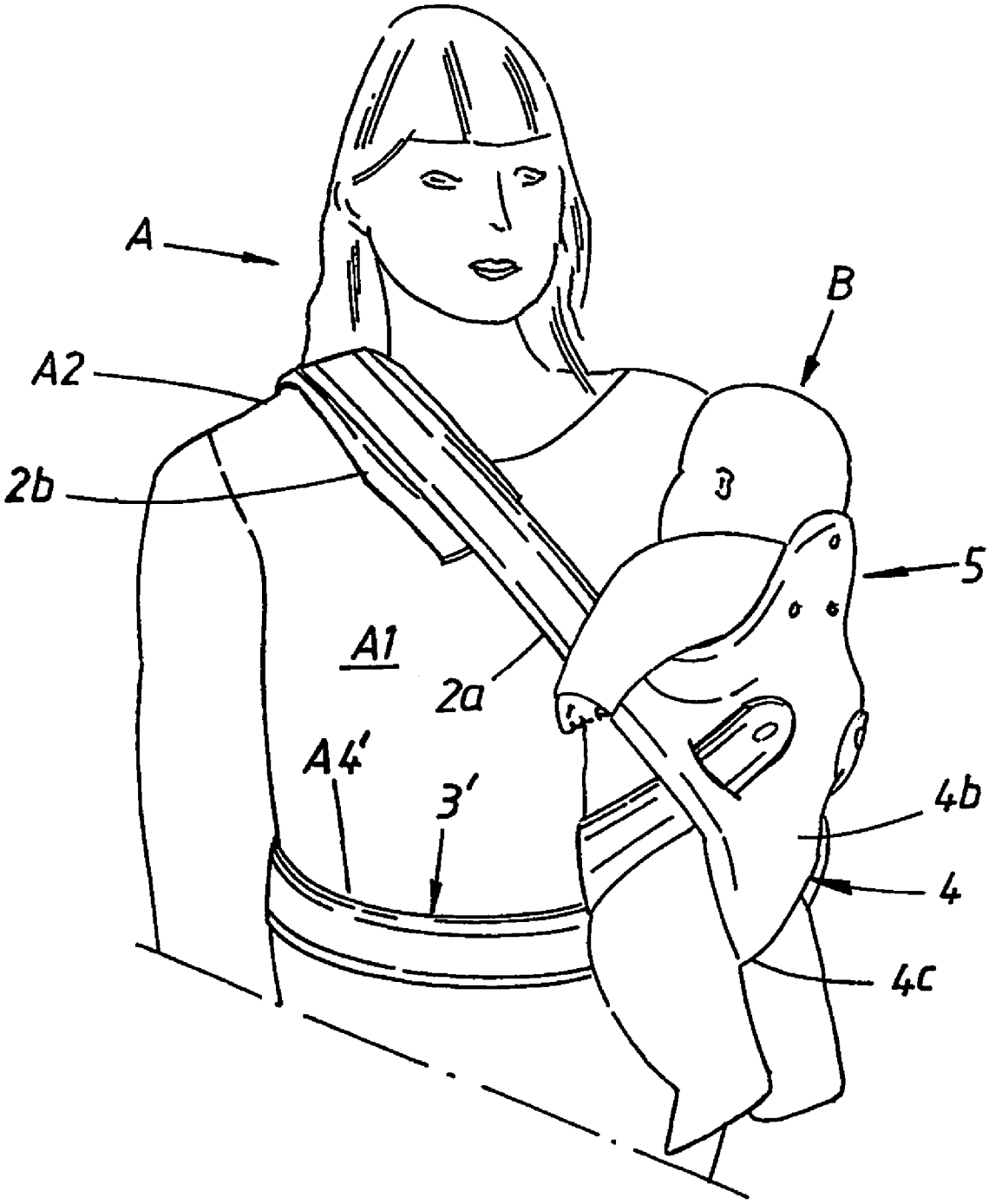
FIG. 4 is a front view of a harness wearer with the inventive harness worn in an alternative position.

FIG. 4 shows an alternative in which the second strap part 3 is placed lower down, in the proximity of the wearer's hips A4'.

A an infant-supporting folded part 4 has a first region 4*a*, which lies proximate, i.e. close to the wearer A, a second region 4*b*, which lies distal from, i.e. away from, said wearer, and a third region 4*c*, which joins together said regions 4*a* and 4*b* and which is much narrower than said first and second regions 4*a*, 4*b*.

These regions 4*a*, 4*b* and 4*c* form different parts of the total area of a single unit 4.

Figure 3:
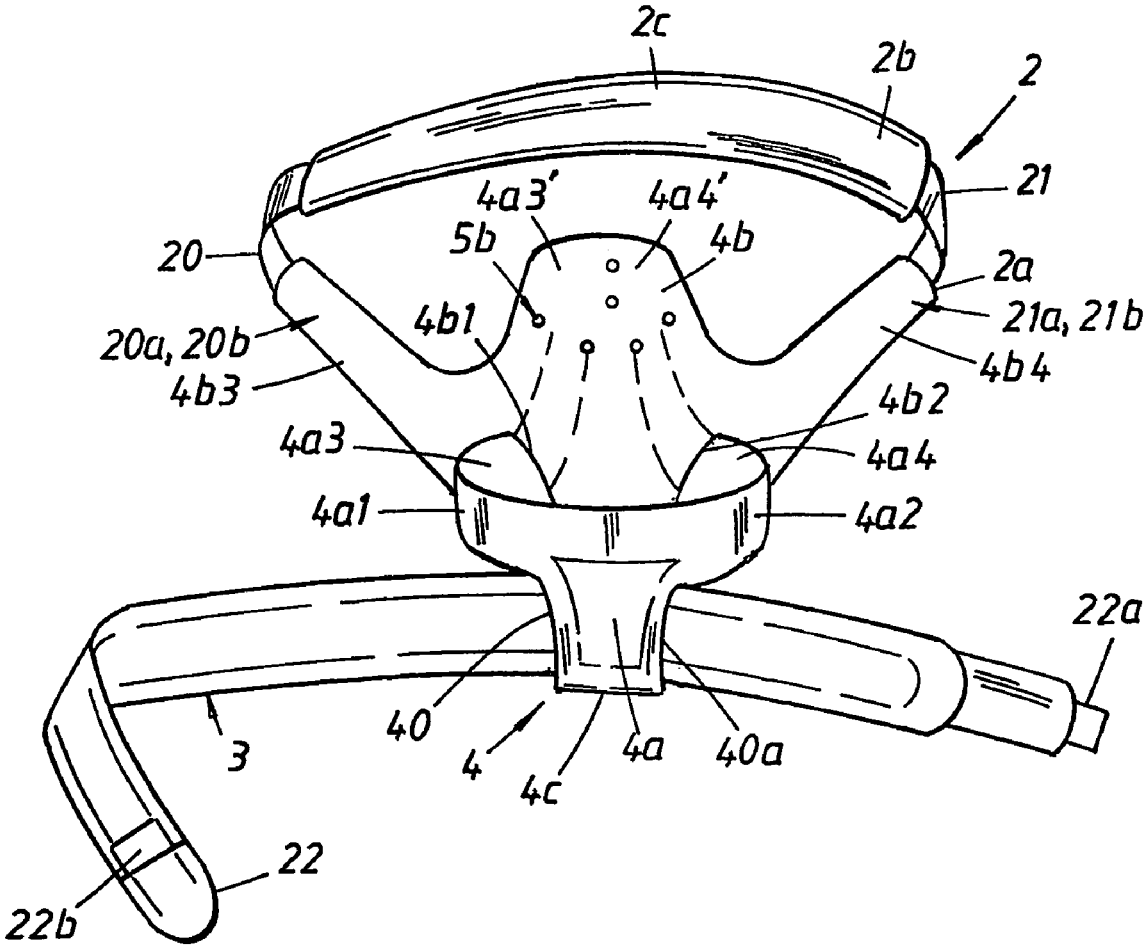
FIG. 3 is a perspective view of the harness design seen from the wearer.

The region 4*a* has the pronounced shape of a truncated triangle shape or the shape of a parallel trapezium with equal sides, and which is shown in FIG. 3 to be upwardly divergent and converging towards the third region 4*c*.

The divergent angles of respective regions are slightly different.

For example, the divergent angle in respect of the first region 4*a* may be between 70 and 110 degrees, such as about 90 degrees.

The divergent angle in respect of the second region 4*b* may be between 50 and 90 degrees, such as about 70 degrees.

The width of the third region 4*c* shall be between 7 and 10 cm, such as about 9 cm, and correspond to the width of the truncated shape of the first and the second regions 4*a* and 4*b*.

Extending from the mutually opposite upper edge portions 4*a*1, 4*a*2 of the first region 4*a* are two strap-forming elongate sections 4*a*3, 4*a*4.

These sections 4*a*3, 4*a*4 are adapted so that at least one section is able to slide through at least one slot 4*b*1 provided in the second region 4*b*.

In the case of the FIG. 3 embodiment, the harness includes two divergent slots 4*b*1, 4*b*2, with a divergent angle of between 70 and 110 degrees, preferably about 90 degrees, and with a smallest distance between said slots of between 11 and 13 cm, for instance about 12 cm.

These slots shall have a somewhat "tight" dimension, by which is meant that the section 4*a*3, 4*a*4 must be pulled through the slots with a well-defined force, and that the load exerted by the infant shall not cause the sections to slide through the slots. This enables loading of the coupling device 5 by the weight of the child or infant to be at least reduced.

The ends 4*a*3', 4*a*4' of the elongate sections 4*a*3, 4*a*4 are provided with and/or co-ordinated with a device 5, a two-part coupling device, that can be readily connected to or readily released from the outer surface 4*b*' of the second region 4*b* distal from the wearer A.

It is particularly shown that the active length of the elongate sections 4*a*3', 4*a*4' can be adjusted. The active or effective length of said sections shall be considered as their extension between the second region 4*b* and the first region 4*a*, namely the region that surrounds the upper leg (thighs) and hips of the infant.

The illustrated embodiment shows that the end portions 4*a*3' and 4*a*4' of two elongate sections are mutually connected with a two-part coupling device 5, or via a first coupling part 5*a*.

More particularly, it is proposed that a number of second parts 5*b* of said two-part coupling device 5 shall be co-ordinated and distributed over the outer surface 4*b*' of the second region 4*b*.

A chosen distribution of said second coupling parts 5*b* is illustrated by dots in FIG. 3. It will be evident from this that two such devices 5*b* are positioned above one another in the upper edge of the second part 4*b*, beneath which two devices are located at mutually the same height but pronouncedly sideways relative to each other, and beneath which two further devices 5*b* are located at the same height but only slightly sideways related. These devices 5*b* are thus adapted either to provide equal active lengths of the sections 4*a*3, 4*a*4 or differently effective section lengths.

Although the two-part coupling device 5 is shown to consist of press studs, it will be understood that other coupling devices can be used.

The length of the first strap part 2 can be adjusted and includes two hook-equipped coupling devices 20, 21.

The coupling device 20 includes a hook element 20*a* and a sleeve-like element 20*b* that receives the hook element 20*a*, while the device 21 includes corresponding elements 21*a*, 21*b*.

The length of the second strap part 3 can also be adjusted, and includes a coupling device 22 equipped with a hooked element 22*a*, and a sleeve-like element 22*b*.

The second strap part 3 is intended to pass through two V-shaped slots 40, 40*a* within the first region 4*a* and adjacent the region 4*c*. The slots 40, 40*a* are spaced with respect to opposite edge portions of the region 4*a*.

The slots 40, 40*a* have a divergent angle of between 30 and 55 degrees, such as about 45 degrees, and the smallest distance between said slots 40, 40*a* is between 4 and 6 cm, for example about 5 cm.

The second region 4*b* is significantly greater than the first region 4*a* and has an upwardly divergent shape, where the uppermost region has a centred, upwardly tapering and rounded configuration whose inwardly facing surface is adapted to serve as a support for the head of the infant B and whose outwardly facing outer surface 4*b*' is adapted to carry a number of second parts 5*b* of said two-part coupling device 5, disposed in the aforesaid manner.

This support may be made more rigid than the remaining regions of the harness.

Connected to the second region 4*b*, at respective sides of the centred, upwardly tapering configuration, are two elongate sections 4*b*3, 4*b*4 that are intended to partially form said first strap portion 2.

FIGS. 5 to 8 inclusive illustrate schematically a second embodiment of an inventive harness 1, that has characteristic features associated with the invention.

Figure 5:
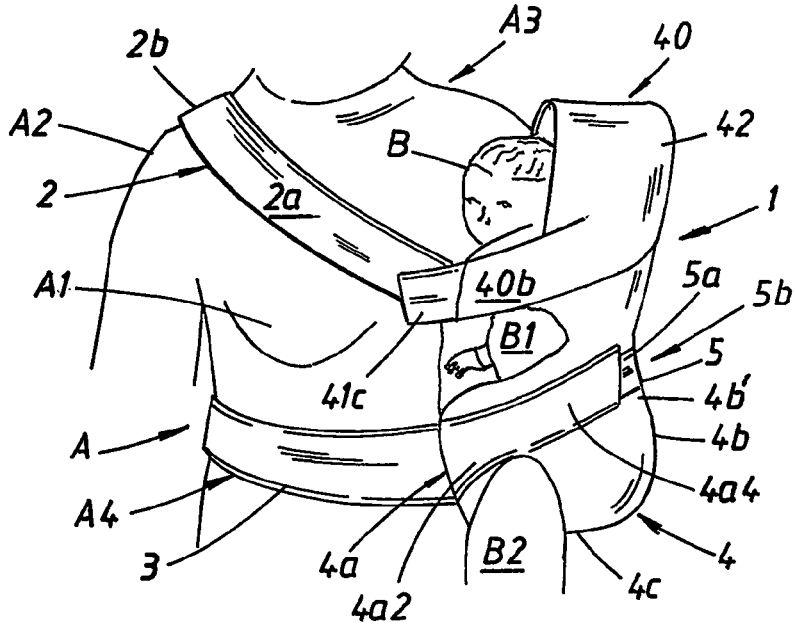
FIG. 5 is a front view of a harness wearer, where the inventive harness is in accordance with a second embodiment of the invention, and shows a child or an infant supported by the harness.
Figure 6:
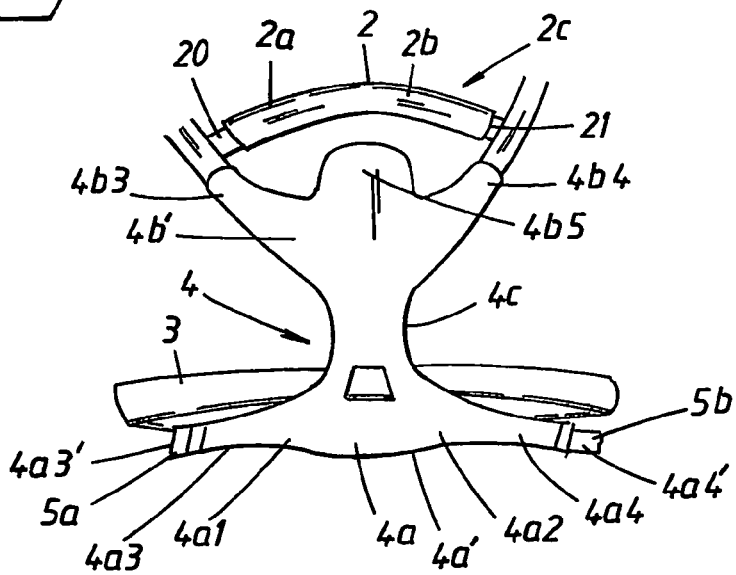
FIG. 6 is a perspective illustration of the harness in FIG. 5, showing said harness in a lain-out state with the second harness region distal from the wearer.
Figure 7:
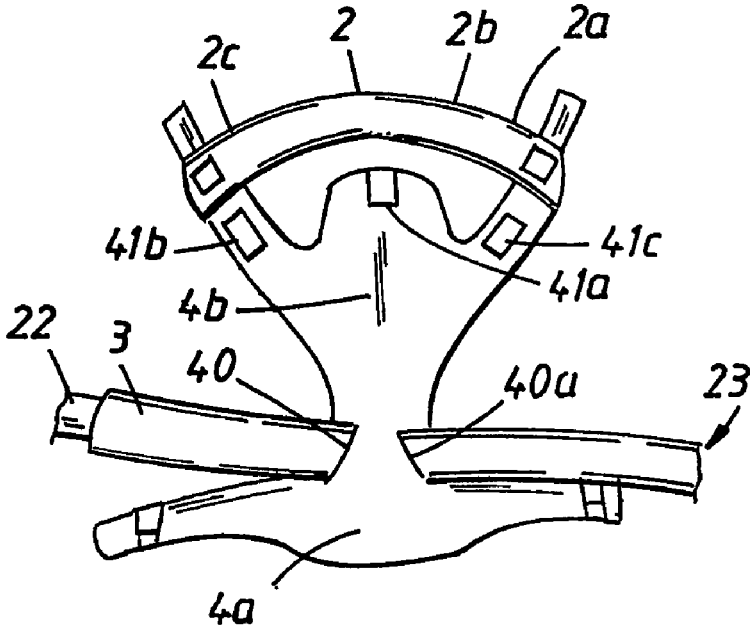
FIG. 7 is a perspective illustration of the FIG. 5 harness in a lain-out state, showing the second harness region proximate to the wearer.

In the case of this embodiment, it is proposed in particular that the second strap portion 3 shall be capable of being placed at a high level, such as immediately beneath the wearer's bust A1, in other words slightly higher than the position shown in FIG. 5.

Corresponding parts have been identified with reference signs corresponding to those used in FIGS. 1-4.

It is particularly proposed, in accordance with the invention, that the neck-supporting hood-configured unit 40 (FIG. 8) can be fastened to an upper part 4*b*5 of the second region 4*b*.

More particularly, it is proposed that the unit 40 can be readily fastened to and readily removed from said upper part 4*b*5 of the second region 4*b* through the medium of a fastener chosen to this end.

In addition to enabling the hood-configured unit 40 to be readily fastened and readily removed, the fastener shall also enable the unit 40 to be adjusted with respect to its lateral and height positions in accordance with a child's requirements in achieving a comfortable position.

Although a number of different functional fasteners are known to the art, it is particularly preferred, in accordance with the invention, that the fastener has the form of a touch-and-lose fastener that has the loop-carrying part on the second region 2*b*.

The fastener 41 between the unit 40 and the upper part 4*b*5 of the second region 4*b* utilises three fastening points 41*a*, 41*b* and 41*c*, of which the fastening point 41*a* is placed centrally adjacent the upper part 4*b*5 of the region 4*b*, whereas the remaining two fastening points 41*b* and 41*c* are related respectively to the elongate sections 4*b*3 and 4*b*4.

It will be noted in particular that all fastenings 41*a*, 41*b* and 41*c* between the hood-configured unit 40 and the upper part 4*b*5 of the second region can be height-adjusted.

Figure 8:
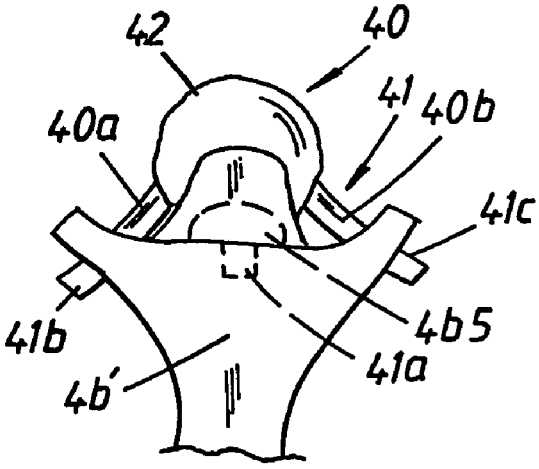
FIG. 8 shows the upper part of said second region with a hood-configured unit fastened thereto.

As shown in FIG. 8, the hood-configured unit 40 includes mutually opposite flaps 40*a* and 40*b*, which can be fastened to the sections 4*b*3, 4*b*4 allocated to the second region 4*b* through the medium of a respective fastener 41*b* and 41*c*.

All fastening points 41*a*, 41*b* and 41*c* of the fastener 41 can be given the form of a touch-and-close fastener, with the loop-carrying fastener parts provided on the upper part of the second region 4*b*.

The hood-configured unit 40 includes a gently and smoothly raisable or collapsible hood-forming part 42, which is located centrally in relation to the flaps 40*a* and 40*b* of the hood unit.

The aforesaid mutually opposite edge portions and/or sections 4*a*3, 4*a*4 are adapted to allow the arms of a baby/infant to be enclosed by the sections and said second part 4*b*. This is not shown in FIG. 5.

On the other hand, FIG. 5 clearly shows that said edge portions and/or sections 4*a*3, 4*a*4 and the flaps 40*a*, 40*b* of the hood-configured unit 40 are adapted to allow the child's arms B1 to pass there between.

FIG. 5 also shows that the child's legs B2 will be embraced by the mutually opposite edge portions or flaps 4*a*1 and 4*a*2 respectively.

The loop-carrying parts of respective fastening points 41*a*, 41*b* and 41*c* of said second part 4*b* shall have a length extension that will satisfy the desired adjustability of the arrangement It will be understood that the invention is not restricted to the afore described and illustrated exemplifying embodiments thereof and that modifications can be made within the concept of the invention illustrated in the accompanying claims.

It will be noted in particular that each illustrated unit and part can be combined with each other illustrated unit and part in a manner to achieve the desired technical function.

The invention claimed is:

1. A wearer-adapted and child/infant supporting harness (1) comprising; a first strap portion (2), which is adapted to extend obliquely over the wearer's chest (A1), over the wearer's shoulder (A2) and obliquely over part of the wearer's back; a second strap portion (3), which is adapted to extend around the wearer (A); and a child-supporting folded part (4), said folded part has a first region (4*a*), that is intended to lie proximal to the wearer (A), a second region (4*b*), that is intended to lie distal from said wearer, and a third region (4*c*), that connects said first and second regions and which is formed narrower than said first and second regions, characterised in that two elongate sections (4*a*3, 4*a*4) are extending from mutually opposite edge portions (4*a*1, 4*a*2) of said first region (4*a*) of the folded part (4); in that said sections (4*a*3, 4*a*4) are adapted to pass slidingly through a respective slot (4*b*1, 4*b*2) provided in said second region (4*b*); and in that end portions (4*a*3', 4*a*4') of said elongate sections are provided with or co-ordinated with means (5) for readily connecting and readily disconnecting said end portions from the wearer-distal outer surface (4*b*') of said second region (4*b*), said second strap portion (3) being passable through two angled slots that together form a V shape in said first region (4*a*).

2. A harness according to claim 1, characterised in that the effective length of said elongate sections (4*a*3, 4*a*4) is adjustable.

3. A harness according to claim 1, characterised in that said end portions (4*a*3', 4*a*4') of the two elongate sections are mutually connected to a first part (5*a*) of a two-part coupling device, serving as said means (5).

4. A harness according to claim 3, characterised in that at least a few second parts (5*b*), of said two-part coupling device, are co-ordinated with an outer surface (4*b*') of said second region.

5. A harness according to claim 1, characterised in that the length of said first strap portion (2) can be adjusted and in that said strap portion is provided with a hook-equipped coupling device.

6. A harness according to claim 1, characterised in that the length of said second strap portion (3) is adjustable and that said strap portion is provided with a hook-equipped coupling device.

7. A harness according to claim 1, characterised in that said second region (4*b*) has an upwardly divergent configuration with an upper tapering shape, where the inwardly facing surface is adapted to server as a support for a child's/infant's head and where the outwardly facing surface (4*b*') is adapted to carry a number of second parts (5*b*) of said two-part coupling device or means (5).

8. A harness according to claim 1, characterised in that two elongate sections (4*b*3, 4*b*4) are connected to said second region (4*b*) to partially form said first strap portion (2).

9. A wearer-adapted and child/infant supporting harness (1) comprising; a first strap portion (2), which is adapted to extend obliquely over the wearer's chest (A1), over the wearer's shoulder (A2) and obliquely over part of the wearer's back; a second strap portion (3), which is adapted to extend around the wearer (A); and a child-supporting folded part (4), said folded part has a first region (4*a*), that is intended to lie proximate to the wearer (A), a second region (4*b*), that is intended to lie distal from said wearer, and a third region (4*c*), that connects said first and second regions and which is formed narrower than said first and second regions, characterised in that two elongate sections (4*a*3, 4*a*4) are extending from mutually opposite edge portions (4*a*1, 4*a*2) of said first region (4*a*); in that said sections (4*a*3, 4*a*4) are adapted to extend behind said second region (4*b*) and to embrace the child/infant and in that the edge portions (4*a*3', 4*a*4') of said elongate sections are provided with or coordinated with means (5), adapted to enable said end portions to be readily connected to and readily disconnected from each other and/or respectively to and from the wearer-distal outer surface (4*b*') of the second region (4*b*), a neck-supporting unit (40) is attachable to an upper part (4*b*5) of said second region (4*b*), and said fastener means (5) being adapted such that a fastening (41) position, between said neck supporting unit (40) and said upper part (4*b*5) of said second region, is adjustable vertically.

10. A harness according to claim 9, characterised in that the effective length of said two elongate sections (4*a*3, 4*a*4) can be adjusted through the medium of said means (5).

11. A harness according to claim 9, characterised in that said end portions (4*a*3', 4*a*4') of respective elongate sections are mutually connected through the medium of a first part (5*a*) and a second part (5*b*) of a two-part coupling device (5), serving as said means.

12. A harness according to claim 9, characterised in that said unit (40) can be readily fastened to and readily removed from said upper part (4*b*5) of the second region (4*b*) through the medium of a fastener means (41*a*, 41*b*, 41*c*) provided to this end.

13. A harness according to claim 12, characterised in that each of said fastener means has the form of a touch-and-close fastener.

14. A harness according to claim 9, characterised in that said neck-supporting unit is hood-configured.

15. A harness according to claim 9, characterised in that each of said fastener means has the form of a touch-and-close fastener.

16. A harness according to claim 14, characterised in that said hood-configured unit (40) includes a collapsible hood-forming part (42).

17. A harness according to claim 9, characterised in that said first region (4*a*) and said second region (4*b*) are co-ordinated over said third region (4*c*) and formed as an integral unit.

18. A harness according to claim 9, characterised in that said means (5), its first (5*a*) and its second (5*b*) parts, has the form of a buckle, clasp.

19. A harness according to claim 9, characterised in that said mutually opposite edge portions or sections (4*a*3, 4*a*4) are adapted to allow the infant's arm to be enclosed by said sections and said second part (4*b*).

20. A harness according to claim 9, characterised in that said edge portions or sections (4*a*3, 4*a*4) and a hood-configured unit (40) and its related flaps (40*a*, 40*b*) are adapted to allow the child's arms to pass there between.

21. A harness according to claim 9, characterised in that the length of said first strap portion (2) is adjustable, and in that said first strap portion includes a hook-equipped coupling device.

22. A harness according to claim 9, characterised in that the length of said second strap portion (3) is adjustable, and in that said second strap portion includes a hook-equipped coupling device.

23. A harness according to claim 9, characterised in that said second strap portion (3) is intended to pass through two angled slots that together form a V shape (40, 40*a*) in said first region (4*a*).

24. A harness according to claim 9, characterized in that said second region (4*b*) has an (upwardly) divergent form with an upper, centrally positioned tapering shape, whose inwardly facing surface is adapted to serve as a support for the head of a child/infant supported by the harness.

25. A harness according to claim 9, characterized in that two elongate sections are connected to said second region (4*b*) such as to only partially form said first strap portion.

26. A harness according to claim 12, characterized in that said hood-configured unit (40) co-acts with the upper portion (2*b*') of the second part (2*b*) via three fastening parts or points.

27. A harness according to claim 26, characterized in that each of said fastening points can be fastened at a selective vertical and lateral position.

* * * * *